US007068805B2

(12) United States Patent
Geddes

(10) Patent No.: US 7,068,805 B2
(45) Date of Patent: Jun. 27, 2006

(54) ACOUSTIC WAVEGUIDE FOR CONTROLLED SOUND RADIATION

(76) Inventor: Earl Russell Geddes, 43516 Scenic La., Northville, MI (US) 48167

( * ) Notice: Subject to any disclaimer, the term of this patent is extended or adjusted under 35 U.S.C. 154(b) by 0 days.

(21) Appl. No.: 10/616,570

(22) Filed: Jul. 11, 2003

(65) Prior Publication Data

US 2005/0008181 A1 Jan. 13, 2005

(51) Int. Cl.
*H04R 1/30* (2006.01)

(52) U.S. Cl. ..... 381/340; 181/187

(58) Field of Classification Search ..... 381/338–341, 381/342, 343; 181/152, 159, 175, 177, 178, 181/185, 187–189, 192, 195
See application file for complete search history.

(56) References Cited

U.S. PATENT DOCUMENTS 4,324,313 A * 4/1982 Nakagawa ..... 181/192
4,469,921 A * 9/1984 Kinoshita ..... 381/340
5,163,167 A * 11/1992 Heil ..... 181/152
6,059,069 A * 5/2000 Hughes, II ..... 181/152
6,581,719 B1 * 6/2003 Adamson ..... 181/182
6,585,077 B1 * 7/2003 Vincenot et al. ..... 181/192

OTHER PUBLICATIONS

Geddes, Audio Transducers, Chapter 6 Aug. 2002, 6 ed Lee publishing, Novi, Mi, US.
Geddes, "Acoustic Waveguide Theory" J. Audio Eng. Soc. vol. 37 # 7/8 Jul. 1989.
Geddes, "Acoustic Waveguide Theory Revisited" J. Audio Eng. Soc., vol. 41, #6 Jun. 1993.

* cited by examiner

*Primary Examiner*—Sinh Tran
*Assistant Examiner*—Walter F Briney, III

(57) ABSTRACT

Acoustic waveguide contours that approximate either or both of the Elliptic Cylinder and the Prolate Spheroidal coordinate systems that allows for a more accurate prediction and control over the sound radiation polar pattern are disclosed.

2 Claims, 5 Drawing Sheets

Section A-A

ACOUSTIC WAVEGUIDE FOR CONTROLLED SOUND RADIATION

BACKGROUND—FIELD OF THE INVENTION

The present invention relates to acoustical sound radiation and a technique for controlling the directional aspects of the radiated sound field via an acoustic waveguide.

BACKGROUND—DESCRIPTION OF PRIOR ART

There is much prior art relating to the control of sound radiated from waveguides, which are also know as horns in the audio sound reproduction field of art. The term waveguides is used here to refer to those contours that adhere to a stricter definition for their construction, as described herein. The concept of a device whose primary task is to control the directional response of the sound radiation, as opposed to a horn whose primary task was acoustic loading, is relatively new. The prior art in the area of horn theory was almost exclusively concerned with the acoustic loading characteristics of such devices and little attention was paid to an accurate definition the internal wavefront configuration or the directional response, which is highly dependent on this internal wavefront configuration.

Classical horn theory is based on the well known equation of Webster known as Webster's Horn Equation. This applicability of this equation suffers from the fact that it is only accurate for relatively small rates of change of the contours that define it or for contours that have very simple geometries (for example straight sided conical). This fact is well described in Chapter six of my text *Audio Transducers* available from GedLee Publishing at www.gedlee.com. The theory found in this work is fundamental to the understanding of this application. The background to the textbook chapter can be found in my papers on the subject of Waveguides, *Waveguide Theory* and *Waveguide Theory Revisited*, both of which are available from The Audio Engineering Society in their Anthology series.

Current practice in the art is to design a horn that has one or more diffraction apertures created by discontinuities in the conduits cross sectional rate of change of area at points along its axis. The wavefront, upon reaching this aperture, will be diffracted into a spherical (or sometimes a cylindrical) wavefront. If the aperture is not symmetric then this diffraction will occur only in the direction of the smallest dimension, for example a narrow slit will diffract the wave only in the direction across the width of the slit. Once the wavefront has been diffracted into a spherical or cylindrical wave, it is constrained to a specific angle by a basically straight side wall although sometimes there is a slight flaring in this section. The final section is sometimes flared more radically at the exit so as to avoid a second diffraction at the mouth. The diffraction technique does work for directivity control but is not without its detrimental consequences. The diffraction at the apertures causes a large amount of wavefront energy to be reflected from the discontinuity aperture back down the waveguide towards its input end, which causes a standing wave within the device. It is not possible to use diffraction as a wavefront control mechanism and not have this characteristic standing wave occur in the device. This standing wave creates the outgoing and incoming wavefronts to interfere resulting in periodic loading effects on the driver and a comb filter effect on the radiated response. This is a principle reason why horns of this type are often deemed to sound poorly.

Another problem with horns based on diffraction is that they exhibit an ambiguous acoustic center. That is, the wavefront that is created has at least two different centers of curvature for the vertical and horizontal patterns. The secondary diffraction at the aperture points creates secondary sources that are displaced in space from the first source—the driver. Two distinct acoustic centers are thus created. This problem is also well known.

It would be desirable to be able to control the wavefront curvature without the use of diffraction, which is the problem that is dealt with in this disclosure.

A direct result of the aforementioned publications on waveguides is a recent trend toward hom/waveguide designs that are derivatives of or minor contour modifications of the Oblate Spheroidal (OS) waveguide, shown in FIG. 1. This geometry was first disclosed in my two earlier papers. The OS coordinates are generated from the Elliptical coordinates (shown in FIG. 2) by rotating these two dimensional (2-D) coordinates about a line normal to this origin at its center. The semi-minor axes of the ellipses make up the lines of constant radial coordinate $\xi$. This creates a disk as the origin with the diameter of the disk equal to the length of the origin in the 2-D plot. The lines emanating from the origin are lines of constant angles $\eta$. The rotation angle is the $\psi$ coordinate, the third coordinate in a three dimension coordinate system.

In an OS waveguide the external shell 10 lies along a coordinate surface for the angular coordinate $\eta$ of the Oblate Spheroidal coordinate system. The specific angle is called $\eta_0$. In an OS waveguide the throat, 20, is that portion of the origin disk that lies within the bounding contour defined by $\eta_0$. A mouth, 30, results when the shell, 10, is terminated at some finite length of the conduit. The wavefronts in this configuration will then correspond to the $\xi$ coordinates in the OS waveguide.

To be mathematically correct, each cross section of a true OS waveguide would be round, however, satisfactory results have sometimes been obtained with waveguides which maintain the proper cross sectional area but are made to slowly form an ellipse at the mouth as these cross sections move from the throat to the mouth. The device contours are circular at the waveguide throat, to match the driver outlet shape, and are modified to become elliptical at the mouth in order to create a radiation pattern that is not axi-symmetric. This transition is done in a gradual manner so as to not unduly disturb the wavefront propagation.

Experience has shown that too much of this waveguide contour manipulation will yield a device with less than optimal performance. It has been found in practice that not much more than about a twenty to thirty degree difference in the radiated polar angles (vertical and horizontal) can be achieved with this technique. Thus a typical polar pattern of ninety by forty degrees, readily obtainable with diffraction based designs, would only be possible with this technique in a compromised design.

The prior art suffers from one or more of the following problems:

- The horn theory used to define the contour lacks the rigor required to predict the shape of the wavefront at the mouth thus limiting the predictive capability of devices that are based on this theory.
- In order to control the polar radiation pattern, diffraction within the device must be used which results comb filter effects and ambiguous acoustic centers.
- Waveguides based on Oblate Spheroidal or similar contours cannot achieve all desirable radiation characteristics.

Objects and Advantages

It is the object of the technique disclosed in this application to define a waveguide contour that is free from the use of diffraction and yet still allows for precise control of the radiated response. This is achieved by using a combination of two coordinate systems and matching the wavefront output of the first to the input of the second. A match between a flat aperture throat and a high aspect ratio mouth can thus be obtained. This new waveguide has characteristics which cannot be achieved with the prior art.

DRAWING FIGURES

REFERENCE NUMERALS IN DRAWINGS

| | |
|---|---|
| 10 | OS Waveguide conduit |
| 20 | OS waveguide throat aperture |
| 30 | OS waveguide mouth aperture |
| 40 | origin line in 2-D Elliptical coordinates |
| 50 | Prolate Spheroidal section |
| 60 | Elliptic Cylinder section |
| 70 | Mouth flare |
| 80 | Mouth termination |
| 90 | Acoustic transducer |

SUMMARY

In accordance with the present invention an acoustic waveguide design is disclosed that is based on a combination of the Elliptical Cylinder (EC) and the Prolate Spheroidal (PS) coordinate systems.

DESCRIPTION

A detailed study of the eleven coordinate systems for which the wave equation is separable reveals that only three of them allows for an input aperture at the throat that is flat (see Audio Transducers Table 6.1). For each of these coordinate systems the radial dimension yields a useful waveguide. A flat origin is desirable since virtually all sources of interest have unidirectional vibration, which creates an essentially a flat source irrespective of the fact that the vibrating surface itself may not be flat—such as a typical domed compression driver diaphragm. The three coordinate systems which allow flat sources are the Oblate Spheroidal (OS), which has a circle as its origin, the Elliptic Cylindrical, which has a rectangle as its origin and finally the Ellipsoidal, which has an ellipse as its origin. The OS devices are widely used and referenced in the prior art discussed above. In my first Waveguide paper, the use of any of the separable coordinate systems as waveguide contours was discussed, however, the possibility of combining two coordinate systems to yield the desired waveguide characteristics was not discussed, except for a simple matching of an OS Waveguide to a Spherical coordinate system waveguide as a way to match the throat size of the OS Waveguide to the driver exit aperture size. No other geometries were discussed and no general technique for matching throat configurations to desired mouth configurations was expounded.

In this application I will describe a means for combining an EC section with a PS section to obtain a device that can have very different directional characteristics in two perpendicular planes, the horizontal and the vertical, a very desirable characteristic.

Figure 1:
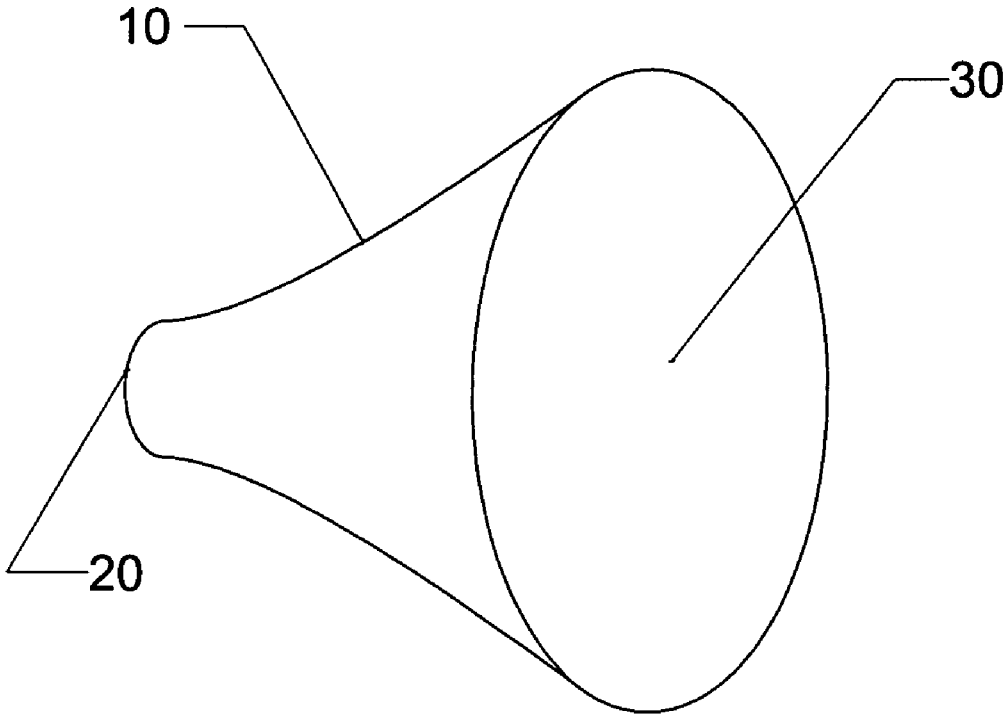
FIG. 1 shows the prior art usage of the Oblate Spheroidal coordinate system in a waveguide.
Figure 2:
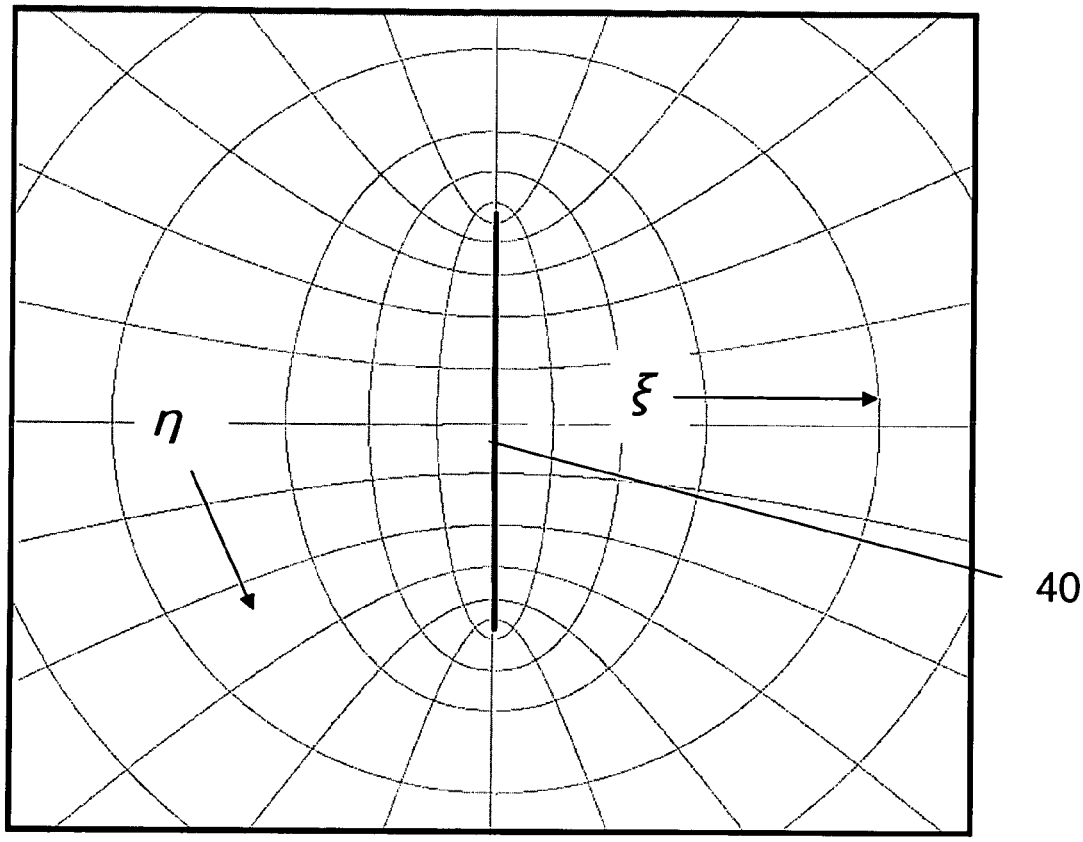
FIG. 2 shows the two dimensional Elliptic coordinate system.

FIG. 2 shows a two dimensional map of the Elliptic coordinate system. When extended into and out of the page the EC coordinates are generated. When rotated about the semi-major axis of the ellipse then the PS coordinates are generated and when rotated about the ellipses semi-minor axis the OS coordinates are generated, as described above. The two dimensional coordinates for each of these coordinate systems are characterized by an angle $\eta$ and the radius $\xi$ with the third coordinate being the angle $\psi$. In waveguides constructed in each of these coordinate systems the wavefronts correspond to the constant $\xi$ surfaces.

When the two foci coalesce into a single point in the above coordinates, then the Circular Cylindrical coordinates are generated for the 2-D case and the Spherical coordinates for the 3-D case.

A PS waveguide has cross sections that are everywhere rectangular. For small angles of $\eta$ the wavefront surfaces that are generated for small radial coordinates in a PS Waveguide are very nearly a section of a cylinder, regardless of the size of the $\psi$ angle. This means that the two angles of the walls of a PS waveguide are uncoupled—they are independent of one another—which is one of the goals. If the smaller of the two orthogonal wall design angles, the vertical and the horizontal, is limited to be small and this angle is allowed to correspond to the $\eta$ direction, then with a very small error r the wavefront required to feed this device can be assumed to be cylindrical. For non-zero values of $\xi$ this section is a finite section of a cylinder. This still poses us a problem since this is not the source wavefront that I want to match. However, as can be seen, again from FIG. 2, an EC waveguide would generate a finite section of a cylinder from a finite source of rectangular cross section with axial vibration. Proper matching of the output of an EC section to the input of a PS section would allow for a flat rectangular source to develop into a non-axi-symmetric section of a sphere at the mouth of the PS waveguide. This is the goal.

The throat of an EC waveguide can be feed by several varieties of sources. First, an actual rectangular source could be used, a phase plug could be made which had a square outlet instead of the usual round one, or a round source could also simply feed the square opening. It is also quite reasonable to assume that a gradual transition from the normal round outlet of a compression driver or speaker to the square section of the EC Waveguide would function without undue degradation of the devices performance, so long as the same cross sectional areas are maintained or grow at a slow rate.

The outlet of the EC waveguide is a section of a cylinder whose dimensions depend on the specifics of this section of the waveguide. If a transition to a PS waveguide is made at a $\xi$ value such that the input shape of the PS waveguide matches the output shape of the EC waveguide then an almost perfect matching of the wavefronts can be achieved. There are many specific angles and locations where this matching can be done and the preferred embodiment is one which minimizes discontinuities in the angles of the walls at the matching location while allowing for the elliptical section to have progressed far enough to have created the nearly cylindrical wavefront required by the PS input. Thus the joining of the two sections is a compromise between two counter relationships. It is a straightforward task to manually determine this matching using typical drawing packages and finding the best fits of the wall angles and shapes graphically. There is no doubt that some mathematical approach could be developed, but in practice it has been found that drafting this transition graphically has been highly effective and efficient.

Figure 3:
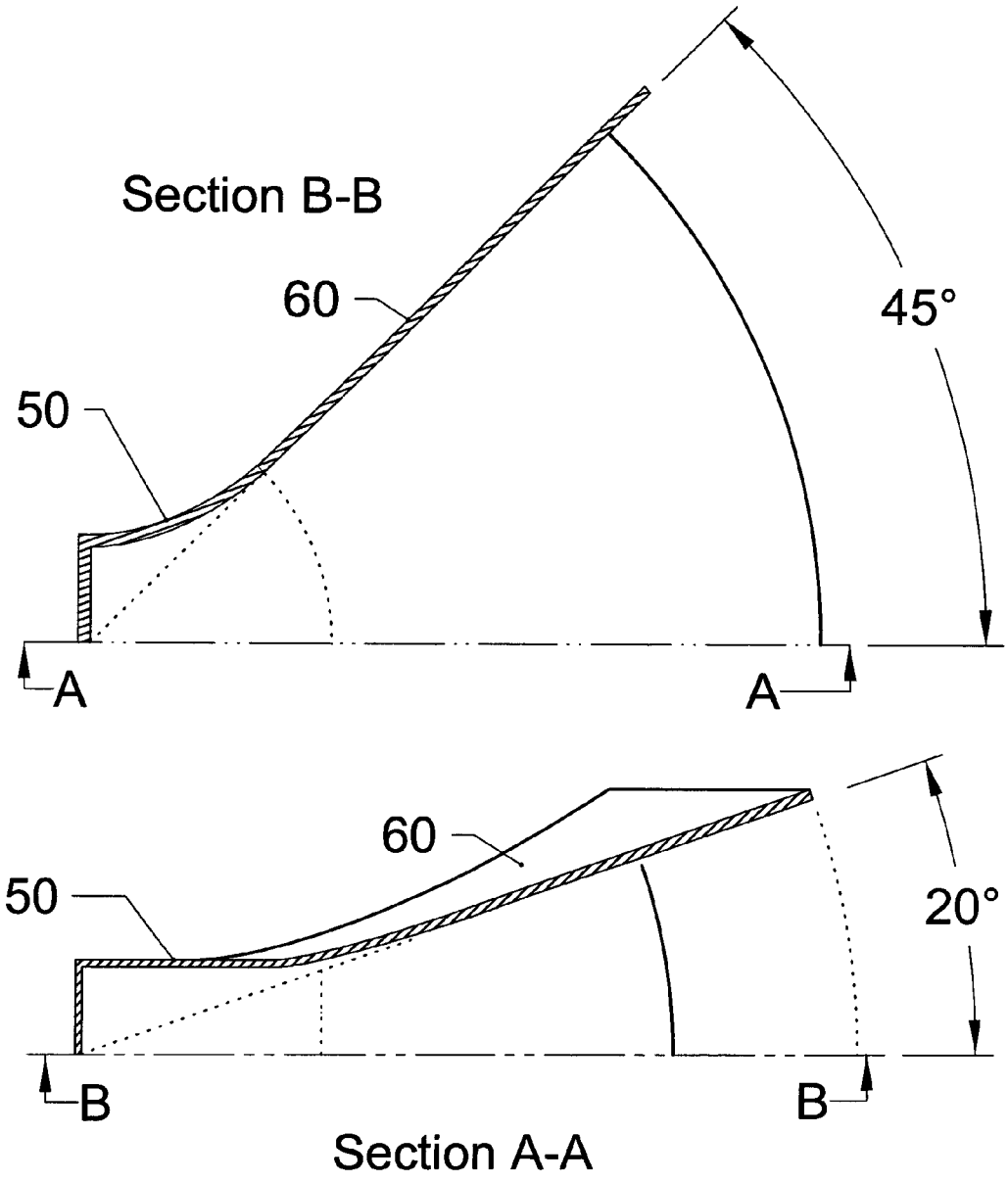
FIG. 3 shows the new Bi-Spheroidal waveguide in two cross sections.

A preferred embodiment of this design is shown in FIG. 3. The waveguide is drawn as two cross sectional drawings in two perpendicular planes which cross along the axis of the device. The EC section, 50, is shown in both views as is the PS section, 60. This new device is called a Bi-Spheroidal™ Waveguide, because it is composed of two waveguides, "Bi", with the outer section being "Spheroidal".

This new device is an improvement on the prior art in that it can achieve widely different directional patterns in two directions without the need for diffraction at any point. This will yield an improved sound quality through the minimization of internal standing waves and the resultant comb filter effect on the radiated response. This new device also does not exhibit an ambiguity as to the acoustic center since there is only a single apparent source with a single radius of wavefront curvature.

Figure 4A:
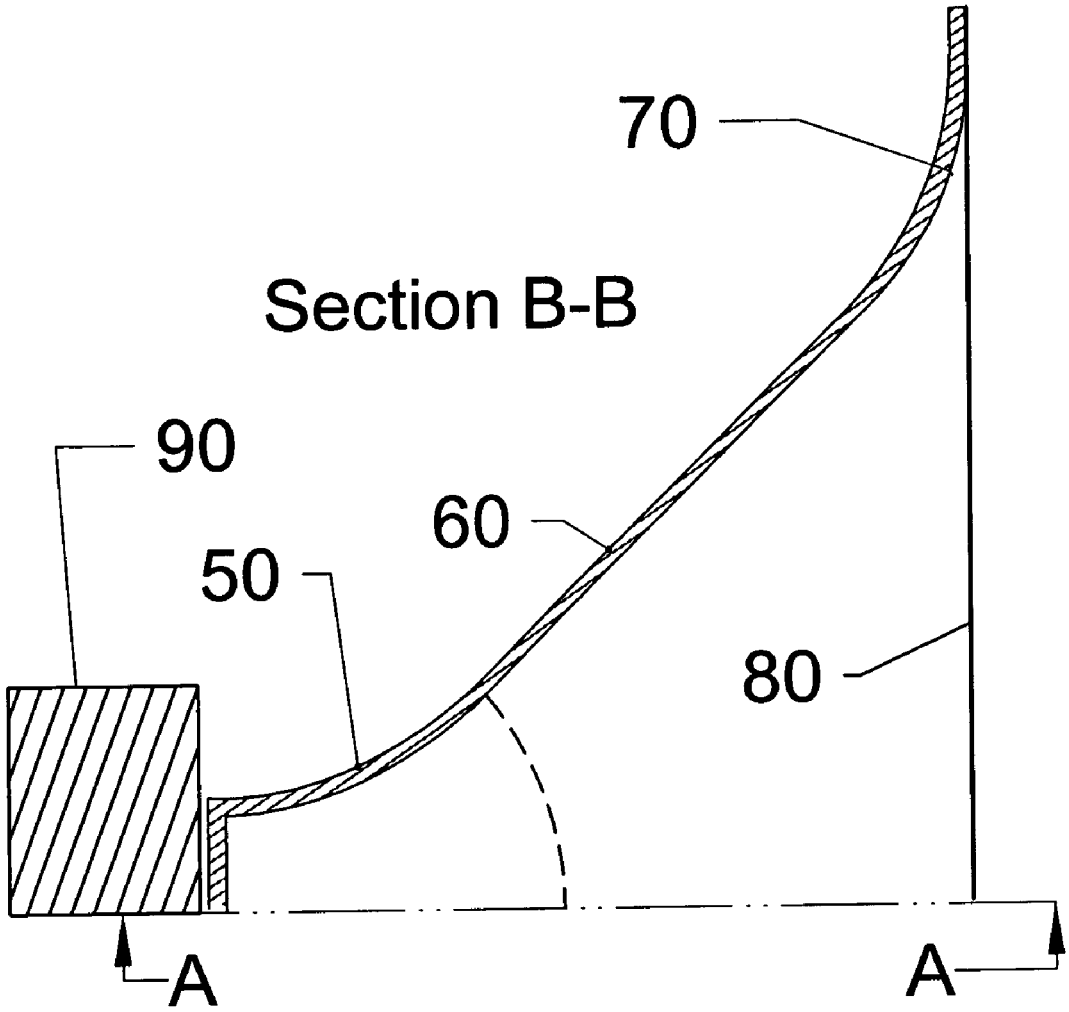
FIG. 4 shows the Bi-Spheroidal Waveguide with a flared exit to minimize diffraction at the mouth.
Figure 4B:
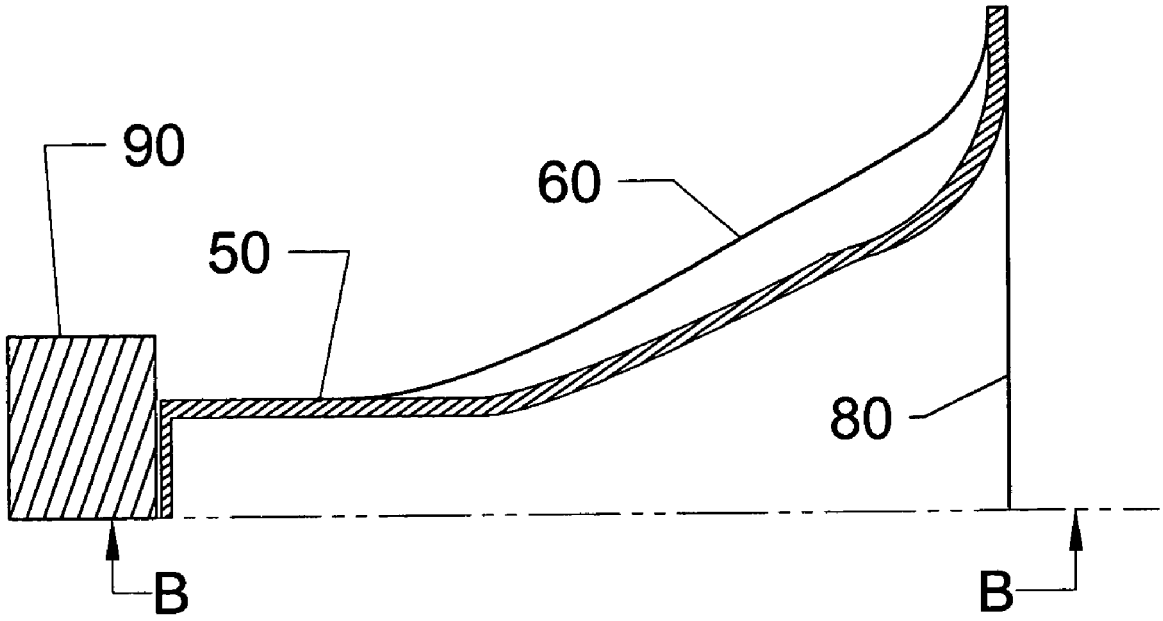

As is customary with a horn, this waveguide should have a flaring, a large radius, at the mouth to reduce diffraction and reflections from the mouth termination. A Bi-Spheroidal Waveguide with a flared mouth into a flat baffle is shown in FIG. 4. The mouth can also be flared into a spherical surface if desired.

It should be noted that in some applications, such as line arrays, the vertical polar pattern will be dominated by the array and thus the vertical pattern for the individual waveguide in this array is not important. In this case it would be desirable not to have any vertical change in the conduits dimensions with length. This would correspond then to a purely EC coordinate system and the PS section would not be required. The waveguide would then be composed of a single EC section.

The preciseness with which one must match the coordinate systems as defined here has never been determined and it is to be noted that small deviations from the coordinate systems defined herein are still to be construed as being within the scope of the claims. For example simplifying the a hyperbolic coordinate curve by circles and lines that closely match said curve will still be within the scope of my invention as these small deviations are not significant in the end product. The EC and PS coordinate surfaces then are to be construed as ideals that can be deviated from without significant deviations from the positive features of these coordinate surfaces as defined within this application.

I claim as my invention:

1. An acoustic waveguide for propagating sound radiation from an acoustic transducer having a throat and a mouth termination, wherein two or more sections along the length of said waveguide have bounding surfaces that are substantially Elliptic Cylinder and Prolate Spheroidal coordinates from the throat to the mouth.

2. The waveguide of claim 1 wherein;

a mouth termination has a radius.

* * * * *